United States Patent [19]

Trapp et al.

[11] Patent Number: 5,007,973

[45] Date of Patent: Apr. 16, 1991

[54] MULTICOMPONENT EXPLOSIVES

[75] Inventors: Richard E. Trapp; Gary L. Hansen, both of Salt Lake City; Robert B. Clay, Bountiful, all of Utah; Lawrence J. Dubetsky, Tamaqua; Robert S. Olney, Bethlehem, both of Pa.

[73] Assignee: Atlas Powder Company, Dallas, Tex.

[21] Appl. No.: 420,341

[22] Filed: Oct. 12, 1989

[51] Int. Cl.[5] ..... D03D 23/00

[52] U.S. Cl. ..... 149/109.6; 149/2; 149/5; 149/44; 149/114

[58] Field of Search ..... 149/2, 109.6, 44, 114, 149/5

[56] References Cited

U.S. PATENT DOCUMENTS

| | | | |
|---|---|---|---|
| Re. 28,848 | 6/1976 | Clay et al. | 149/2 |
| 2,890,108 | 6/1959 | Toulmin, Jr. | 52/0.5 |
| 2,927,849 | 3/1960 | Greblick et al. | 52/0.5 |
| 3,153,606 | 10/1964 | Breza et al. | 149/41 |
| 3,297,502 | 1/1967 | Chrisp | 149/6 |
| 3,447,978 | 6/1969 | Bluhm | 149/2 |
| 3,453,158 | 7/1969 | Clay | 149/41 |
| 3,456,589 | 7/1969 | Thomison et al. | 102/23 |
| 3,539,406 | 11/1970 | Lissant | 149/109 |
| 3,709,747 | 1/1973 | Nixon et al. | 149/22 |
| 3,745,078 | 7/1973 | Alley et al. | 149/76 |
| 3,765,967 | 10/1973 | Funk et al. | 149/21 |
| 3,797,392 | 3/1974 | Eckels | 102/23 |
| 3,875,189 | 4/1975 | Petty | 149/109.4 |
| 3,899,374 | 8/1975 | Sylkhouse | 149/2 |
| 3,914,209 | 10/1975 | Petty | 149/19.3 |
| 3,926,698 | 12/1975 | Cook et al. | 149/44 |
| 3,927,836 | 12/1975 | Thurgood et al | 241/19 |
| 4,058,420 | 11/1977 | Barnhard, IV et al. | 149/2 |
| 4,110,134 | 8/1978 | Wade | 149/2 |
| 4,111,727 | 9/1978 | Clay | 149/2 |
| 4,138,281 | 2/1979 | Olney et al. | 149/2 |
| 4,294,633 | 10/1981 | Clay | 149/2 |
| 4,357,184 | 11/1982 | Binet et al. | 149/2 |
| 4,371,409 | 2/1983 | Cartwright et al. | 149/94 |
| 4,388,254 | 6/1983 | Maes et al. | 264/3 C |
| 4,416,711 | 11/1983 | Jessop et al. | 149/42 |
| 4,456,494 | 6/1984 | Maes et al. | 149/21 |
| 4,526,633 | 7/1985 | Lawrence et al. | 149/109.6 |

OTHER PUBLICATIONS

"Pyrrole & Pyrrole Derivatives", vol. 19, pp. 499–520.

*Primary Examiner*—Stephen J. Lechert, Jr.
*Attorney, Agent, or Firm*—Richards, Medlock & Andrews

[57] ABSTRACT

A multicomponent explosive composition and its use as a blasting agent in ditching operations and the like. The explosive comprises a fuel component and an oxidizer compnent, both of which are retained in the liquid state over wide temperature ranges and are stable over long storage intervals. The fuel component comprises a suspension of a particulate metal fuel, specifically aluminum, in a carrier liquid formed of a mixture of a water-miscible polyhydric alcohol and a pyrrolidone solvent. The carrier liquid contains a thickening agent to provide thixotropic rheological properties such that the particulate metal fuel remains in suspension at rest, but with shear forces induced by pumping, the components become more fluid for mixing and pumping easily. The oxidizer component comprises an aqueous solution of an inorganic oxidizer salt. The oxidizer solution contains void-containing materials such as glass or saran microbubbles. The void-containing materials may be suspended in the fuel component also. The fuel and oxidizer components are stored in separate reservoirs and transported to the location of the detonation site. The components are separately metered from their respective reservoirs and supplied to a static mixing zone where they are mixed together.

37 Claims, 2 Drawing Sheets

MULTICOMPONENT EXPLOSIVES

FIELD OF THE INVENTION

This invention relates to explosive compositions and more particularly to multicomponent explosive compositions incorporating a metallic fuel in liquid suspension and an oxidizer salt solution and methods for their formulation.

BACKGROUND OF THE INVENTION

Explosive compositions based upon particulate fuels dispersed in solutions or suspensions of water soluble inorganic oxidizing salts are well known in the art. For example, U.S. Pat. No. 3,456,589 to Thomison et al. discloses a slurry explosive formulated from at least one inorganic oxidizing salt, a non self-detonating fuel, water, a liquid organic fluid extender and usually also a gelling or thickening agent. Gaseous voids provided by hollow glass particles are incorporated into the slurry explosive in order to reduce its density and enhance detonability of the slurry explosive. The particulate metal fuels in the Thomison formulation may be employed either alone or in mixture with other fluids such as carbonaceous fuels. Suitable metallic fuels include aluminum, magnesium, silicon, iron, ferrosilicon, ferrophosphorous and mixtures and alloys of such metals. The particulate metals are employed in sizes ranging from about 8-200 mesh and in amounts up to about 50 wt. %, with about 10-30 wt. % being preferred. Oxidizer salts which may be employed in the Thomison formulation include ammonium, alkali metal and alkaline earth metal nitrates, and perchlorates and mixtures thereof. Liquid fluid extenders disclosed for use in the Thomison formulation include ethylene glycol, propylene glycol, glycerol, formamide and low molecular weight mono-hydroxy alcohols such as methanol. Polymeric thickening agents disclosed in the Thomison patent for use in formulating the slurry explosives include polysaccarides such as gum arabic, guar gum, caraya gum and synthetic polymers such as polyacrylamides and polyvinyl alcohols. In preparing an explosive formulation, a thickening agent is dispersed in propylene glycol followed by the addition of water and formamide. Crushed sodium nitrate and ammonium nitrate are then added, followed by glass microbubbles and particulate aluminum. A cross-linking agent i then added and the explosive composition allowed to gel. U.S. Pat. No. 3,297,502 to Chrisp discloses a water-based explosive incorporating an inorganic oxidizing salt and a particulate metal fuel which is coated in order to protect the metallic particles from the aqueous phase of the explosive formulation. The metallic fuels which are subject to the coating procedure include light elements such as aluminum, magnesium, zinc, boron and silicon and heavier metallic alloys such as ferrophosphorous and ferrosilicon. Coating may be accomplished by using an aliphatic mono-carboxylic acid containing from about 8-22 carbon atoms, together with an oil having a viscosity of about 30-400 SUS at 100° F. Numerous thickening agents are disclosed in Chrisp and include gums, starches, cellulose derivatives such as carboxymethylcellulose, polyacrylamides and partially hydrolyzed polyacrylamides and synthetic biopolymers such as the excellular heteropolysaccaride B-1459. A winter fluidizing (antifreezing) agent can be incorporated in order to enable explosive formulations to retain handling properties down to about −10° F. Fluidizing agents disclosed in Chrisp include ethylene glycol, monoethylether and diethylene glycol as well as various other materials including those disclosed in the Thomison patent.

U.S. Pat. No. 3,765,967 to Funk et al. discloses a slurry explosive comprising finely divided aluminum, having particle sizes such that most will pass through a 325 US sieve, in a salt solution containing about 20-60 wt. % of alkali or alkaline earth metal perchlorate or ammonium perchlorate in a fully dissolved state in a mixture of water and an organic fuel, which may be a diol such as ethylene glycol or a low molecular weight alcohol such as methanol or ethanol or mixtures thereof. Self-explosives may also be employed in the formulation as well as entrapped gas bubbles.

U.S. Pat. No. 4,388,254 to Maes et al. discloses a procedure for making an aqueous slurry-type blasting composition from two separately packaged components. One component comprises a nitrate oxidizer or ammonium nitrate or a mixture of ammonium nitrate with alkali or alkaline earth metal nitrates. The second component comprises a slurry of a finely divided metal such as aluminum in water together with a gelling or thickening agent. The aluminum may include a coating agent to prevent reaction with water. A small amount of a glycol such as propylene glycol is incorporated into the second component in order to aid in dispersing the gelling agent. The two components may be mixed on site together with additional water to provide the explosive composition.

SUMMARY OF THE INVENTION

In accordance with the present invention there is provided a multicomponent explosive composition and its use as a blasting agent in ditching operations and the like. The explosive components comprise a fuel component and an oxidizer component both of which are retained in the liquid state over wide temperature ranges and which are safe and stable over long storage intervals which can be for days, weeks, or even months. The fuel component comprises a suspension of a particulate metal fuel in a carrier liquid formed of a mixture of a water-miscible polyhydric alcohol and a pyrrolidone solvent. The carrier liquid contains a thickening agent in a type and amount sufficient to provide thixotropic rheological properties such that the particulate metal fuel remains in suspension at rest, but with shear forces induced by pumping, the components become more fluid for mixing and pumping easily. The thickening agent is in an amount effective to provide a viscosity of at least 2000 centipoises at 20° C. as measured with a Brookfield Viscometer, Model No. RVT, using a No. 4 spindle at 20 rpm, and no more than 100,000 centipoises at −20° C. as measured above but using a No. 6 spindle at 10 rpm. Unless otherwise indicated, viscosity values given herein are as measured with a Brookfield Viscometer, Model No. RVT. Viscosity values specified in the claims at 20° C. are for a shear rate of 20 rpm with a No. 4 spindle, and those at −20° C. are for a shear rate of 10 rpm with a No. 6 spindle.

The preferred metal fuel for use in the invention is aluminum having an average particle size range within the range of about 5-100 microns. The polyhydric alcohol desirably is selected from the group consisting of ethylene glycol, diethylene glycol, propylene glycol, glycol ethers and glycol ether acetates. Ethylene glycol is preferred since it is easily thickened through the use of polymeric thickening agents as described below and is also an effective freezing point depressant. The preferred pyrrolidone solvent is N-methyl-2-pyrrolidone.

The oxidizer component comprises an aqueous solution of an inorganic oxidizer salt. Suitable oxidizer salts which may be employed in the present invention include water-soluble ammonium, alkali metal, alkaline earth metal, nitrates and perchlorates which are disclosed in the aforementioned patents to Thomison et al., Chrisp and Funk et al. Sodium perchlorate is preferred for use in the present invention because of its high solubility in water at low temperatures and because of its characteristic of forming a low freezing point eutectic at high concentrations and providing good oxygen balance characteristics when the two components are mixed. Where other water-soluble oxidizer salts are employed, such as the aforementioned nitrates, it will be desirable to also employ sodium perchlorate in the oxidizer solution, preferably in a predominant amount.

The oxidizer solution preferably contains the void cell materials (such as glass or saran microbubbles, although occluded air can also be used provided the solution is sufficiently viscous to retain the air bubbles in suspension) minor amounts of a polyhydric alcohol (preferably ethylene glycol) and a thickening agent. The thickening agent desirably is present in a type and amount effective to provide thixotropic rheological properties to the mixture that will enhance the suspension of bubbles during storage conditions and promote fluidity for mixing and pumping of the mixture. The viscosity for the oxidizer solution is at least 2000 centipoises at 20° C. as measured with a No. 4 spindle at 20 rpm. The closed cell void containing material preferably is present in an amount sufficient to provide a density of the oxidizer component of no more than 1.25 g/cc and preferably no more than 1.21 g/cc. The void cell materials may be suspended in the fuel component, also. In such cases, the oxidizer component may vary from about 1.31 to about 1.71 g/cc.

The sodium perchlorate normally is present in the oxidizer component in an amount within the range of about 40–70 wt. %. The aforementioned eutectic for a water sodium perchlorate system is found at about 56% sodium perchlorate, corresponding to about 54% sodium perchlorate assuming that about 4% of thickener ethylene glycol, microbubbles and other materials are present in the oxidizer solution, and the most preferred sodium perchlorate concentration is within the range of about 50–60 wt. %.

The fuel and oxidizer components are stored in separate reservoirs and transported to the location of the detonation site. The components are separately metered from their respective reservoirs and supplied to a static mixing zone, e.g., a zone where they are mixed under tortuous flow conditions, using static baffles or screens or the like as contrasted with impellers or other moving parts.

In accordance with a further aspect of the invention, there is provided a preferred method for formulating the fuel component of the multicomponent explosive composition. In carrying this embodiment of the invention, a hydratable polymeric thickening agent is incorporated into a polyhydric alcohol carrier liquid in an amount effective to impart a thixotropic rheological property to the total liquid-fuel component capable of suspending particles of aluminum at rest. Thereafter, the pyrrolidone solvent is added to the thickened alcohol. This is followed by incorporating the closed-cell void containing material if it is chosen to use all or part of this material in the fuel component. The last ingredient to be added is the particulate metal fuel into the mixture of polyhydric alcohol and pyrrolidone solvent with or without the closed-cell void-containing material. Preferably, the pyrrolidone solvent is N-methylpyrrolidone as described above, the alcohol is ethylene glycol, and the ratio of N-methylpyrrolidone to thickened ethylene glycol is within the range of 1:2–2:1, and more preferably 2:3–3:2.

DETAILED DESCRIPTION

Figure 1:
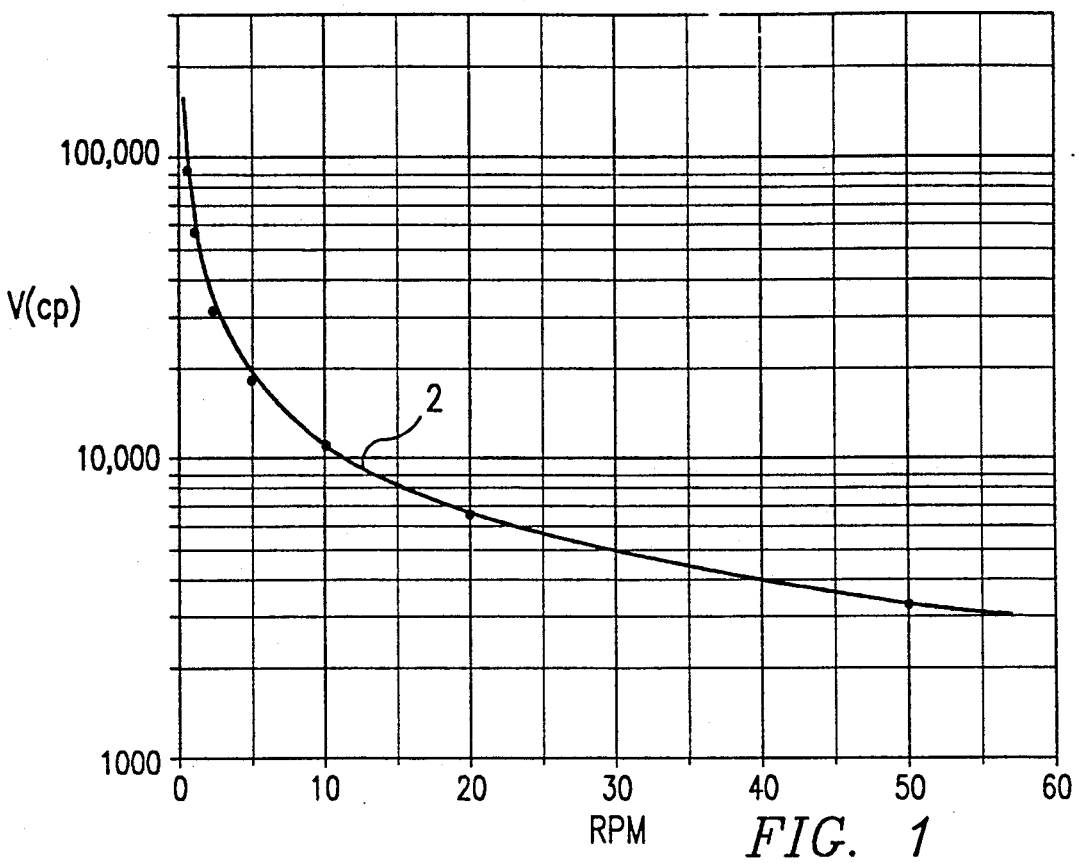
FIG. 1 is a graph of viscosity versus shear rate for an oxidizer component which may be employed in carrying out the invention.

There are a number of applications in which the multicomponent explosive compositions of the present invention may be advantageously employed. These include military operations, for example, the blasting of ditches to provide "tank traps" in order to impede the advance of armored vehicles. Other operations in which the invention may be employed include the blasting of fire break lines to confine forest fires and in flood control applications such as the blasting of dikes, blasting of alternative water flow channels, deepening of channels, removal of underwater obstructions, etc.

In both military and non-military applications, the oxidizer and fuel components employed in the present invention can be mixed on site and forced into flow channels provided by hoses or pipes which may be relatively short or relatively long, ranging in lengths of from about 100 feet up to 1000 feet or more. In ditching operations involving the excavation of tank traps or flood control channels, the hose or plastic pipe providing the explosive channel typically will vary from about 4–6 inches in diameter and be buried at depths ranging from about 4–10 feet. In other applications, the flow channels may be buried to a shallow depth of perhaps 1–2 feet or they may be simply laid on the ground. For example, in the blasting of fire break lines, relatively small diameter hoses, typically about 1–3 inches in diameter, can be placed in shallow trenches or simply laid on top of the ground. As will be recognized in view of the experimental data described later, the explosive composition of the present invention can be formulated to provide detonability using a standard booster at a critical diameter, the minimum diameter at which detonation can be achieved, as small as 1 inch.

The use of two liquid components in accordance with the present invention offers significant advantages over alternative procedures in which dry components are added in formulating an explosive formulation at the detonation site. The precise metering and on-site mixing of liquid and dry components is often difficult to achieve within the desired degree of tolerance. Where one of the components includes a dry particulate fuel such as aluminum powder, difficulties and hazards are involved in storage, handling and mixing of the powdered fuel. For example, fine aluminum powder creates a dust hazard in the ambient air which can cause an explosion if inadvertently ignited. Even aside from the danger of explosion, ingestion or inhalation of the aluminum dust is hazardous to personnel and, accordingly, masks must be worn while processing the aluminum and mixing it into the explosive formulation.

Liquid components can be more easily mixed within the requisite degree of tolerance than those systems which include a dry component. However, in employing liquid components, it is desirable that the components remain stable for long periods of time and over wide ranges of temperature. Military applications require stability and pumpability at −25° F. (−32° C.). While commercial standards may be less demanding, pumpability over wide temperature ranges and stability, especially at relatively high temperatures, is important in nonmilitary as well as in military applications. The present invention meets these criteria. The fuel component is extremely stable and shows substantially no settling at temperatures ranging up to 70° C. after two weeks of storage. At the same time, pumpability is retained at temperatures down to −32° C. and even below, depending upon the amount of pyrrolidone solvent in the system and also the amount of aluminum. The liquid oxidizer component can likewise be retained in a liquid state down to −32° C. by employing sodium perchlorate at a concentration meeting the eutectic point criterion described previously and/or by employing an antifreeze agent such as ethylene glycol or propylene glycol in the oxidizer solution.

As noted previously, the present invention involves the use of a pyrrolidone solvent in conjunction with a polyhydric alcohol in the fuel component of the explosive formulation. The use of a pyrrolidone solvent in an explosive formulation is, in itself, not novel. Thus, U.S. Pat. No. 4,371,409 to Cartwright et al. discloses a high explosive composition comprising metriol trinitrate and diethylene glycol dinitrate in which various polar compounds, including N-methyl-2-pyrrolidone, may be employed as polar compatibility additives. The N-methyl-2-pyrrolidone or other polar compatibility additives in Cartwright are employed in very small amounts, specifically 0.20% or less.

In the present invention, a substantial amount of the pyrrolidone solvent is employed in the fuel component of the explosive formulation. The amount of the pyrrolidone solvent is dictated to some extent by the total concentrations of carrier liquid and particulate fuel in the fuel component. These parameters in turn vary, depending upon the proportions in which the fuel and oxidizer components are mixed, the oxygen balance of the resulting mixture and its detonability according to detonation site conditions. As will be understood by those skilled in the art, detonability is dependent upon the density of the mixed explosive formulation, with a decrease in density favoring detonation, the diameter of the pipe or the flow channel into which the formulation is pumped, with larger diameters favoring detonation, and temperature, with higher temperatures favoring detonation.

The oxygen balance of the explosive formulation after mixing the fuel and oxidizer components ideally is neutral oxygen balance. In determining oxygen balance for the heavily aluminized explosives involved in the present invention, water must be considered as an oxidizer since it reacts with aluminum in a highly exothermic reaction to form aluminum oxide ($Al_2O_3$) and hydrogen gas ($H_2$). Sodium perchlorate or other oxidizer salts must be present in a high enough percentage to obtain good detonability since water and aluminum alone will not sustain detonation unless sensitized with a more reactive oxidizer salt. Account must be taken not only of the metallic fuel but of the other materials such as the pyrrolidone solvent, polyhydric alcohol, and thickener, e.g. guar gum, which also provide fuel values. Thus, an amount of pyrrolidone solvent which is most effective in terms of providing for good flowability and stability of the fuel component may be undesirable in the sense that it results in over fueling of the ultimate explosive formulation. As a practical matter, the pyrrolidone solvent will normally be present in the fuel component in an amount of at least 5 wt. % and will seldom exceed 25 wt. %. Usually it will be present in an amount within the range of about 10–20 wt. %. As described below, the amount of pyrrolidone solvent can also be characterized in terms of the ratio of solvent to polyhydric alcohol.

As indicated previously, the preferred order of formulating the fuel component is addition of the polymeric thickening agent to the polyhydric alcohol carrier liquid followed by addition of pyrollidone solvent to the thickened carrier liquid and then incorporation of the particulate metal into the carrier liquid mixture. Preferably, the thickening agent is added to the polyhydric alcohol in an amount to impart a viscosity to the alcohol within the range of 1,000–10,000 centipoises at 20° C. and 20 rpm employing a No. 4 spindle. Where glass microbubbles or other closed-cell void-containing material is employed in the fuel component, it normally is added prior to the particulate metal fuel.

Experimental work carried out respecting the invention demonstrates the results achieved by the invention and also the advantages of the invention over alternative binary systems employing liquid-liquid components but without the use of a pyrrolidone solvent. The fuel and oxidizing salt used in both the alternative binary blasting agent and the present invention were aluminum and sodium perchlorate. Aluminum from several sources was used. These products were finely ground materials having particle size distributions ranging from a few microns to about 200 microns in diameter with average particle sizes from about 20 to 50 microns and predominant particle size distributions within the range of 20 to 80 microns. Polyhydric alcohols were used in the experimental work including diethylene glycol, ethylene glycol, and diethylene glycol monomethylether. Thickeners used were xanthan gum and guar gum. Void cells were used as density reducing agents and took the form of glass microbubbles having an average particle size of about 90 microns. Additional materials used in the experimental work as described herein include a surface active agent available from Lubrizol Corporation under the designation OS-80457 which functions as a dispersant and fluidizing agent and an organo silane which functions as a coating agent and acts to enhance the hydrophobicity of the particulate aluminum fuel. A suitable organo silane is an octyltrimethoxysilane available from Degussa Corp. under the designation Silane 108. Silane 208, an octyltriethoxysilane, is also a good coating agent. The pyrrolidone solvent used in the experimental work was N-methyl-2-pyrrolidone available from BASF Chemical Company and referred to herein simply as methylpyrrolidone or NMP as it is abbreviated in the Tables.

The basic binary explosive system against which the invention was evaluated comprises a fuel component in the form of a suspension of aluminum carrier liquid formed of a mixture of ethylene glycol and diethylene glycol and an oxidizer component comprising an aqueous solution of sodium perchlorate. The fuel and oxidizer component were mixed in equal weight parts to provide the explosive formulation. The compositions of the fuel and oxidizer components and the compositions of the resulting explosive formulation after mixture of the two components are set forth below in Table I.

TABLE I

| | PCT. of Component | PCT. in Explosive Composition |
|---|---|---|
| Fuel Component No. 1 | | |
| Ethylene Glycol | 14.3 | 7.65 |
| Diethylene Glycol | 7.7 | 3.85 |
| Thickener (Xanthan Gum) | 0.025 | 0.0125 |
| Fluidizer (Lubrizol OS80457) | 0.6 | 0.3 |
| Aluminum (Reynolds LSB580) | 77.375 | 38.6875 |
| | 100.000 | |
| Oxidizer Component | | |
| Sodium Perchlorate | 53.9 | 26.95 |
| Water | 42.3 | 21.15 |
| Ethylene Glycol | 1.0 | 0.5 |
| Thickeners | | |
| (Xanthan Gum) | 0.1 | .05 |
| (Guar Gum E-2) | 0.3 | 0.15 |
| Buffers (Acetic Acid & NaOH) | 0.3 | 0.15 |
| Microbubbles | 2.1 | 1.05 |
| | 100.0 | 100.0 |

In Table I the weight percent of the constituents of the individual fuel and oxidizer components are set forth in the first column, and the weight percent of these constituents in the final explosive formulation is set forth in the second column. The explosive formulation was successfully detonated in unconfined diameters of 3 inches. However, this binary system would not meet specified military pumpability requirements at −32° C. Also, the fuel component settled and underwent separation after storage for about 60 days in a hot desert environment, although the suspension could be reconstituted by mixing. The fuel component had a viscosity at room temperature of about 30,000 to 40,000 cp. At −25° C. it was a firm nonflowable mass.

Additional modified fuel components employing mixtures of polyhydric alcohols as the carrier liquids were formulated and tested after mixing with equal weight parts of the oxidizer component identified above in Table I. These modified fuel components and certain characteristics thereof are set forth below in Table II.

TABLE II

| | FUEL COMP. 2 | FUEL COMP. 3 |
|---|---|---|
| Methyl Carbitol (DM) | 0 | 7.407 |
| Ethylene glycol | 19.5 | 13.241 |

TABLE II-continued

| | FUEL COMP. 2 | FUEL COMP. 3 |
|---|---|---|
| Diethylene glycol | 10.5 | 7.130 |
| Lubrizol Fluidizer | 0.6 | 0.556 |
| Thickener | 0.034 | 0.023 |
| Aluminum | 69.366 | 71.643 |
| Room temperature Viscosity (cps) | 4000 | 2500 |
| Density g/cc | 1.83 | 1.88 |
| Viscosity Mixed Explosive −20° C. (cps) | — | 5300 |
| Density mixed explosive g/cc, 20° C. | — | 1.49 |
| Visc. Component A −20° C. (cps) | Firm | 8200 |
| Predicted ΔP (Psi/Ft.) | — | 1.93 |

Component No. 2, when mixed with the oxidizer solution, failed to detonate at 0° C. in an unconfined diameter of 3 inches. A formulation employing component No. 3 had marginal detonation characteristics, failing in one instance and detonating in another, at an unconfined diameter of 3 inches at −32° C.

Explosive systems similar to those described above but based upon a fuel component in which methylpyrrolidone was incorporated into the carrier liquid were pumpable at temperatures of −32° C. and were also stable in the sense of being resistent to settling when stored at elevated temperatures.

The impact of the pyrrolidone solvent on the viscosity of the fuel component carrier liquid in comparison with various other solvent combinations is illustrated in Table III. The liquid systems depicted in Table III include various combinations of ethylene glycol (EG), diethylene glycol (DEG), diethylene glycol monomethylether (DM) and N-methylpyrrolidone (NMP).

TABLE III

| Carrier Liquid | 1 | 2 | 3 | 4 | 5 | 6 | 7 | 8 | 9 |
|---|---|---|---|---|---|---|---|---|---|
| | | | Weight Percent | | | | | | |
| EG | 65 | 60 | 40 | 50 | 60 | 55 | 50 | 45 | 40 |
| DEG | 35 | — | 28 | 26.5 | — | — | — | — | — |
| EM | — | 40 | 32 | — | — | — | — | — | — |
| NMP | — | — | — | 23.5 | 40 | 45 | 50 | 55 | 60 |
| | | | Viscosity (cp) | | | | | | |
| 20° C. | 56 | — | — | 42 | 36 | 32 | 28 | 21 | 20 |
| −20° C. | 352 | 120 | 160 | 156 | 104 | 76 | 72 | 40 | 30 |
| −32° C. | 760 | — | — | 500 | 176 | 156 | 136 | 85 | 65 |
| −40° C. | 1900 | — | — | 1340 | 304 | 224 | 200 | 150 | 100 |
| −50° C. | frozen | — | — | frozen | frozen | 700 | 296 | — | — |
| −60° C. | — | — | — | — | — | 2160 | 400 | — | — |

The viscosity values reported above in Table III, as well as in the other tables, were obtained using a Brookfield Viscometer, Model No. RVT. In general, viscosities were measured using a No. 2 spindle at 20 rpm. As can be seen from an examination of Table III, the low temperature viscosity characteristics of the carrier liquid improve substantially with increasing pyrrolidone content.

The viscosity values given in Table III are useful for comparative purposes only and are not representative of actual viscosities encountered in the fuel formulations in which the viscosity is increased due to the use of thickening agents and also because of the fine particulate fuel in suspension. However, the trend indicated in Table III is also evident in formulations in which the particulate fuel and thickening agents are employed. Stability and viscosity characteristics of carrier liquids incorporating pyrrolidone are shown in Table IV, and similar characteristics for the other carrier liquid formulations employing the polyhydric alcohols of Table III are illustrated in Table V. As can be seen, the pyrrolidone incorporating fuel components showed substantially better high temperature stability and low temperature viscosity characteristics than the formulations set forth in Table V.

TABLE IV

| Mix No. | 3-5-A | 3-5-B | 3-5-C | 3-5-D |
|---|---|---|---|---|
| Formulation (Parts) | | | | |
| EG | 15 | 15 | 15 | 15 |
| Thickeners K1A112 | 0.06 | 0.06 | 0.06 | 0.06 |
| Gum in EG | | | | |
| Pyrrolidone | 15 | 15 | 15 | 15 |
| Silane 108 Coating | — | 0.1 | — | 0.1 |
| Lubrizol Fluidizer | — | — | 0.6 | 0.6 |
| ALCAN Aluminum | 70 | 70 | 70 | 70 |
| Initial | | | | |
| Visc. @ 20° C. | 2950 | 3300 | 3400 | 3100 |
| Visc. @ 70° C. | 2000 | 1800 | 2000 | 1700 |
| Visc. @ −20° C. | 16000 | 16500 | 36500 | 25000 |
| Visc. @ −32° C. | — | — | — | 58000 |
| Visc. @ −40° C. | — | — | — | 120000 |
| After | | | | |
| 8 days @ 70° C. | stable | stable | stable | stable |
| 9 days @ 70° C. | trace free liq. (no settling) | trace free liq. (no settling) | stable | stable |
| 15 days @ 70° C. | settling (minimal) | settling (minimal) | settling (minimal) | stable |
| Visc. 15 days @ 70° C. | 1500 | 1400 | 1600 | 3800 |
| After 1 year @ 20° C. | | | | slight amt free liquid on top, no settling |

TABLE V

| Ingredient (Parts) | 1 | 2 | 3 | 4 |
|---|---|---|---|---|
| Ethylene Glycol | 18 | 15 | 12 | 10 |
| Thickener | 0.05 | 0.06 | 0.05 | 0.045 |
| Diethylene Glycol | 12 | — | 8 | 7 |
| Glycol Ether | — | 12 | 8 | 8 |
| Coating | 0.08 | 0.2 | 0.2 | — |
| LZ-38J Zirconate Coating | — | — | — | 0.35 |
| Fluidizer | — | 0.6 | — | 0.6 |
| Aluminum Powder | 70 | 73 | 72 | 74 |
| Viscosity (cP @ 20° C.) | 3300 | 6350 | 4550 | 8850 |
| Stability @ 20° C. after 2 weeks | Separated & Settled | Slight Separation & Settling | Slight Separation & Settling | Slight Separation & Settling |
| Stability @ 70° C. after 1 week | Separated | Separated | Separated | Separated |
| Viscosity | | | | |
| @ −20° C. | 49000 | 40000 | 37000 | — |
| @ −32° C. | 150000 | 84000 | 88000 | 1 million |
| @ −40° C. | 200000 | 135000 | 250000 | |

As indicated previously, increased pyrrolidone content relative to the polyhydric alcohol in the carrier liquid results in substantially enhanced low temperature pumpability characteristics. However, the amount of pyrrolidone solvent, as well as other liquid fuel components, must be considered in view of the amount of particulate fuel in order to arrive at the appropriate oxygen balance for the mixed explosive formulation. Table VI illustrates the relationship between increasing pyrrolidone content and decreasing aluminum content with the polyhydric alcohol remaining constant.

TABLE VI

| Formulation (%) | 1 | 2 | 3 | 4 | 5 |
|---|---|---|---|---|---|
| Thickened EG* | 10 | 10 | 10 | 10 | 10 |
| NMP | 15 | 16 | 16.5 | 18 | 18 |
| Silane 108 | 0.1 | 0.1 | 0.1 | 0.1 | |
| Silane 208 | | | | | 0.2 |

TABLE VI-continued

| Formulation (%) | 1 | 2 | 3 | 4 | 5 |
|---|---|---|---|---|---|
| Lubrizol Fluidizer | 0.6 | 0.6 | 0.6 | 0.6 | 0.6 |
| Atomized Aluminum | 74.3 | 73.3 | 72.8 | 71.3 | 70.2 |
| 3M Glass Bubbles Type K-1 | 0 | 0 | 0 | 0 | 1.0 |
| Viscosity (cp) | | | | | |
| 70° C. | | | | | 3000 |
| 20° C. | 5750 | 4750 | 4100 | 2900 | 6100 |
| −20° C. | | | | | 61,000 |
| −32° C. | 178,000 | 116,000 | 71,000 | 41,000 | 164,000 |
| −35° C. | | | | | 178,000 |
| −38° C. | | | | | 206,000 |
| −40° C. | 196,000 | 126,000 | 85,000 | — | |

*EG containing 0.5% Xanthan Gum Thickener

The very high viscosity values reported above, normally those on the order of 100,000 centipoises or above, were generally measured using a No. 6 spindle at 2½ or 5 rpm as required by instrument capabilities.

Further experimental work was carried out to determine the detonability of various explosive formulations produced from mixtures of fuel components having different quantities of particulate fuel and varying pyrrolidone/ethylene glycol ratios and oxidizer components having different concentrations of glass microbubbles to vary the density of the oxidizer component and, ultimately, the density of the mixed formulation. The compositions of the fuel components and oxidizer components used in this experimental work are set forth in Tables VII and VIII, respectively.

TABLE VII

| Ingredient | A1 | A2 | A3 | A4 | A5 |
|---|---|---|---|---|---|
| Thickened EG | 18 | 15 | 13 | 10 | 10 |
| NMP | 12 | 15 | 13 | 16.5 | 18 |
| Coating Agent | 0.1 | 0.1 | 0.1 | 0.1 | 0.2 |
| Fluidizer | 0.6 | 0.6 | 0.6 | 0.6 | 0.6 |
| Aluminum | 69.3 | 69.3 | 73.3 | 72.8 | 70.2 |
| Glass Bubbles* | | | | | 1.0 |
| Density (g/cc) | 1.84 | 1.83 | 1.94 | 1.91 | 1.65 |
| Oxygen Balance (g/g) (approximate) | −1.13 | −1.15 | −1.12 | −1.15 | −1.16 |

TABLE VIII

| Formulation (Parts) | B1 | B2 | B3 |
|---|---|---|---|
| Sodium Perchlorate | 53.9 | 53.9 | 53.9 |
| Water | 42.3 | 42.3 | 42.3 |
| Thickener "A" | 0.1 | 0.1 | 0.1 |
| Co-thickener "B" | 0.3 | 0.3 | 0.3 |
| Ethylene Glycol | 1.0 | 1.0 | 1.0 |
| Glass Bubbles* | 2.1 | 2.6 | 3.6 |
| Buffers | 0.3 | 0.3 | 0.3 |
| Density (g/cc) | 1.20 | 1.14 | 1.07 |
| Oxygen Balance (g/g) ($H_2O$ = 0.89) | 0.66 | 0.66 | 0.66 |

*Available from 3M Co.

The ethylene glycol designated in Table VII contained 0.5%, based upon the amount of ethylene glycol, of xanthan gum as a thickening agent. Acetic acid was used in trace amounts in the formulations set forth in Table VIII to buffer the solution to a pH of 4.3.

Detonation results of various mixtures of fuel and oxidizer components are set forth below in Table IX. The detonation results were obtained for charges in PVC pipe at the diameters indicated. The charges were primed with pentalite boosters, with the exception of the No. 8 cap sensitivity test where no booster was used. The boosters were of slightly smaller diameter than the PVC pipe in order to readily accommodate insertion of the boosters into the pipes. The length/diameter ratios of the boosters were at least 1. The blasting cap used to detonate the booster was usually emplaced in the cap well of the booster to a depth of about ½".

The detonation results are presented in terms of critical diameters, that is, for detonation, the minimum diameter at which detonation was achieved, and for failure, the maximum diameter at which no detonation occurred.

TABLE IX

| | RATIO A2/B2 | | | |
|---|---|---|---|---|
| | 60/40 | 55/45 | 50/50 | 40/60 |
| Density (g/cc) | 1.47 | 1.45 | 1.44 | 1.36 |
| Oxygen Balance (%) | −44 | −34 | −25 | −6 |
| Detonation Results @ 20° C. | | | | |
| Critical Diameter | | | | |
| Detonation (inches) | 3 | 2.5 | 1.25 | 1.0 |
| Failure (inches) | 2.5 | 2 | 1.0 | 0.75 |
| Detonation Results @ −37° C. | | | | |
| Critical Diameter | | | | |
| Detonation (inches) | — | — | 2.5 | — |
| Failure (inches) | 3 | 3 | 2 | 3 |

| | RATIO A2/B3 | | | |
|---|---|---|---|---|
| | 60/40 | 55/45 | 50/50 | 40/60 |
| Density (g/cc) | 1.46 | | 1.37 | 1.32 |
| Oxygen Balance (%) | −44 | −34 | −25 | −6 |
| Detonation Results (20° C.) | | | | |
| Critical Diameter | | | | |
| Detonation (inches) | 3.0 | | 1.25 | 0.75 |
| Failure (inches) | 2.5 | | 1.00 | |
| No. 8 Blasting cap sensitivity test | | | | Failed to initiate |

| | RATIO A4/B3 | | | |
|---|---|---|---|---|
| | 60/40 | 55/45 | 50/50 | 40/60 |
| Density (g/cc) | 1.47 | | 1.37 | 1.31 |
| Oxygen Balance (%) | −44 | −34 | −25 | −6 |
| Detonation Results (20° C.) | | | | |
| Critical Diameter | | | | |
| Detonation (inches) | 3.0 | | 1.00 | 0.75 |
| Failure (inches) | 2.0 | | 0.75 | |
| Detonation Results (−28° C.) | | | | |
| Diameter | | | | |
| Detonation (inches) | | | 2 | |

| | RATIO A3/B1 | | | |
|---|---|---|---|---|
| | 60/40 | 55/45 | 50/50 | 40/60 |
| Density (g/cc) | | | 1.50 | |
| Oxygen Balance (%) | −41 | −32 | −23 | −5 |
| Detonation Results | | | | |
| 2 inch Dia. @ 20° C. | | | Detonated | |
| 1.5 inch Dia. @ 20° C. | | | Detonated | |
| 1.25 inch Diam. @ 20° C. | | | Failed | |
| 2.5 inch. Dia. @ −3° C. | | | Detonated | |

| | RATIO A4/B2 | | | |
|---|---|---|---|---|
| | 60/40 | 55/45 | 50/50 | 40/60 |
| Density (g/cc) | 1.49 | | 1.44 | 1.40 |
| Oxygen Balance (%) | −44 | −34 | −25 | −6 |
| Detonation Results (20° C.) | | | | |
| Critical Diameter | | | | |
| Detonation (inches) | 2.5 | | 1.25 | 1.00 |
| Failure (inches) | 2.0 | | 1.00 | 0.75 |

| | RATIO A5/B2 | | | | |
|---|---|---|---|---|---|
| | 60/40 | 55/45 | 50/50 | 40/60 | 35/65 |
| Density (g/cc) | 1.41 | 1.40 | 1.38 | 1.35 | 1.31 |
| Oxygen Balance (%) | −44 | −34 | −25 | −6 | +2 |
| Detonation Results (20° C.) | | | | | |
| Critical Diameter | | | | | |
| Detonation (inches) | 2.0 | | 1.0 | 0.75 | 0.75 |
| Failure (inches) | 1.5 | | .75 | | 0.50 |
| Detonation Results (−36° C.) 3 inch dia. | Failed | Detonated | | | |

The results of the tests using various mixtures of fuel component A5 and oxidizer component B2 show the advantages of using the closed cell void-containing material in both of the fuel and oxidizer components. As indicated by the various ratios of components A5 and B2, a wide variation in the mixing ratio of the two components can be used with less change in sensitivity than when the void-containing material is employed only in the oxidizer component.

Figure 2:
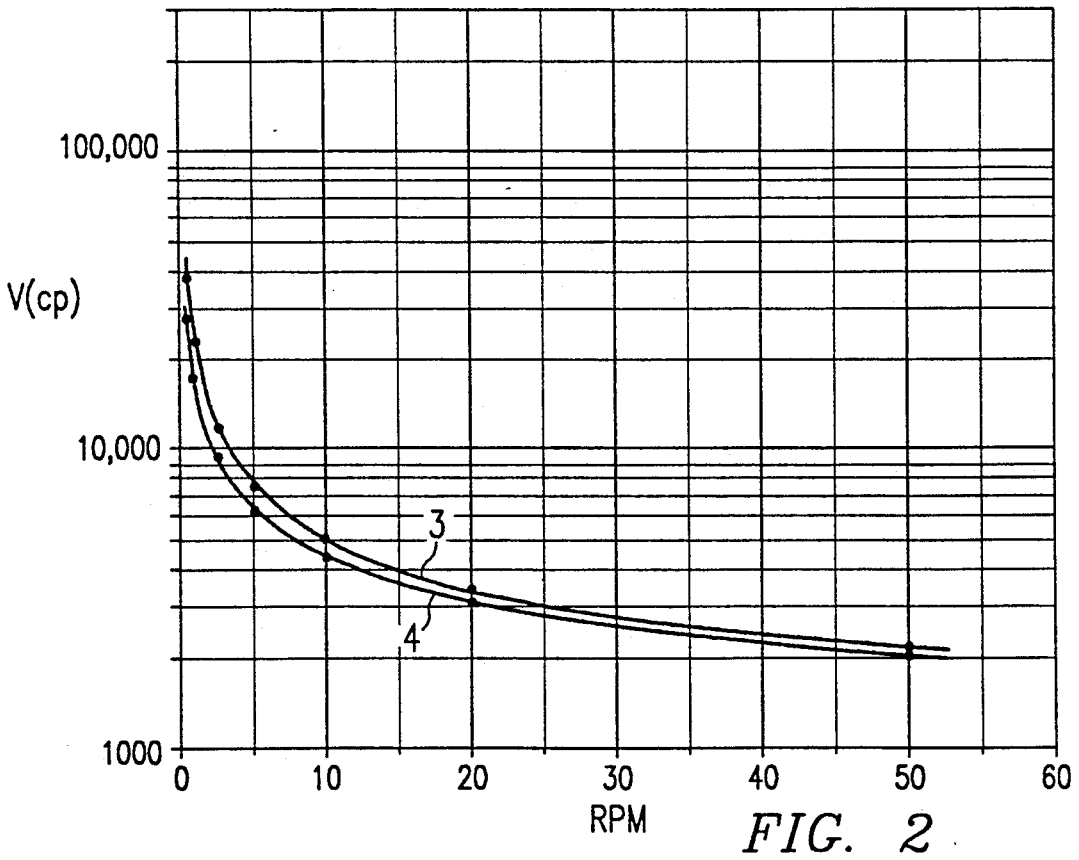
FIG. 2 is a graph of viscosity versus shear rate for fuel components which may be employed in carrying out the invention.

As indicted previously, it is preferred that both the fuel components and the oxidizer components be highly thixotropic in order to provide for good stability during long periods of storage. Thixotropy of the oxidizer component is important from the standpoint of maintaining the glass microbubbles or other void containing material in suspension for long periods of time. Thixotropy of the fuel component is important in order to maintain the aluminum, and also the microbubbles, when they are employed in the fuel component, in suspension. Illustrative rheologic characteristics of the oxidizer and fuel components are illustrated in FIGS. 1 and 2, respectively. In FIG. 1, curve 2 is a graph of viscosity versus shear rate for the component B1 of Table VIII as measured at 20° C. using a Brookfield Viscometer, Model No. RVT, with a No. 4 spindle. In FIG. 1, viscosity (V) in centipoises is plotted on the ordinate versus revolutions per minute (RPM) of the Brookfield Viscometer on the abscissa. In FIG. 2, curves 3 and 4 are viscosity versus shear rate curves for components A2 and A4 of Table VII, also at 20° C. Similarly, as for FIG. 1, viscosity (V) in centipoises is plotted on the ordinate versus the viscometer spindle speed in revolutions per minute (RPM) on the abscissa.

Figure 3:
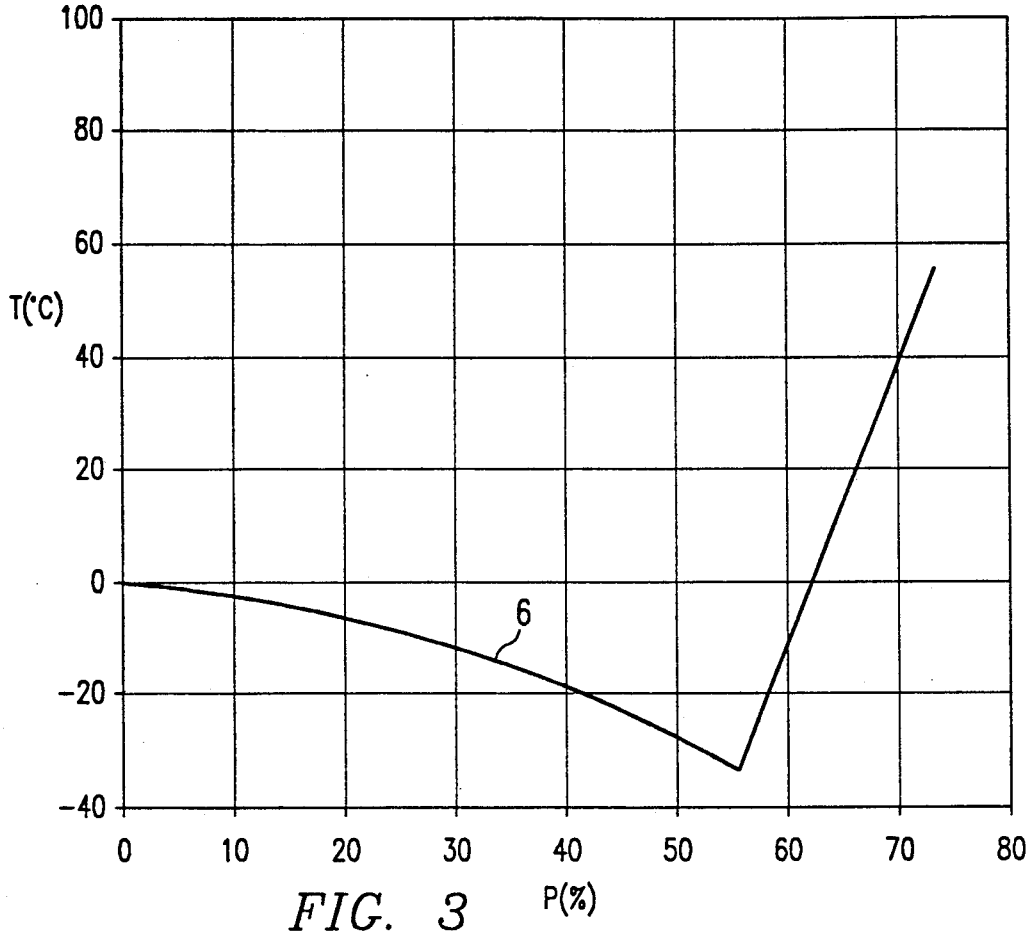
FIG. 3 is a phase diagram illustrating a water-sodium perchlorate eutectic.

While oxidizer salts other than sodium perchlorate may be employed, as discussed previously, sodium perchlorate is highly preferred not only from a standpoint of arriving at a suitable oxygen balance in the final formulation, but also because of its high solubility in water and its capability of forming a eutectic point at −32° C. in the water solution The water sodium perchlorate eutectic is shown in the phase diagram of FIG. 3 in which curve 6 is a plot of freezing temperature (T) in ° C. on the ordinate, versus sodium perchlorate concentration in weight percent (P) on the abscissa As shown in FIG. 3, the eutectic occurs at about 56% sodium perchlorate Since the oxidizer solution also contains minor amounts of other components, the optimum sodium perchlorate concentration in the overall solution, in terms of eutectic point, is about 54% sodium perchlorate. Lower or higher amounts of sodium perchlorate may, however, be used in the solution depending upon the low temperature pumpability characteristics required, which often will be less demanding in commercial operations than in military applications, and also in the amount of ethylene glycol or other polyhydric alcohol employed in the oxidizer solution. As noted previously, it is usually desirable to employ about 1% ethylene glycol in the oxidizer solution. Greater amounts can be employed in order to depress the freezing point of the oxidizer solution. As a practical matter, the sodium perchlorate should be present in the oxidizer solution within the range of about 40–70 wt. %, and more preferably, within the range of about 45–60 wt. %. Maximum or near maximum advantage can be taken of the eutectic point by maintaining the sodium perchlorate solution within the range of about 50–56 wt. %.

The density of the final mixed explosive formulation should be less than 1.55 g/cc at 20° C. in order to provide for reliable detonability. The maximum density will depend upon the low temperature conditions for which the formulation is designed and also the charge diameter, as will be understood by those skilled in the art. As a practical matter, it will be preferred to provide sufficient microbubbles in the oxidizer or fuel solution or both to provide a density within the range of 1.40 to 1.50 g/cc for the mixed explosive.

As noted previously, the preferred polyhydric alcohol for use in the present invention is ethylene glycol. However, other water-immiscible polyhydric alcohols can also be used. As a practical matter the polyhydric alcohol will be selected from the group consisting of ethylene glycol, propylene glycol, diethylene glycol, diethylene glycol monomethylether and mixtures thereof. Viscosity enhancement through the use of one or more thickening agents such as those described previously is necessary in order to provide sufficient viscosity to the carrier liquid at the normal ambient temperature conditions. As a practical matter, the fuel component should have a minimum viscosity of at least 2000 cp at 20° C. as measured with a No. 4 spindle at 20 rpm in order to provide for the requisite stability upon the addition of the pyrrolidone solvent and the particulate metal fuel.

As indicated previously, the weight ratio of methylpyrrolidone and ethylene glycol normally is within the range of 1:2–2:1 and more preferably within the range of 2:3 and 3:2. Within these ranges, the relative amounts of N-methylpyrrolidone and ethylene glycol may vary depending upon application requirements and characteristics. In terms of ensuring low temperature detonability, it may be preferred to employ somewhat less N-methylpyrrolidone than ethylene glycol. For example, in a series of tests a mixture of two parts methylpyrrolidone and three parts ethylene glycol was found to be more reliably detonable at −32° C. than a mixture of equal parts of pyrrolidone and ethylene glycol. On the other hand, mixtures in which the ratio of pyrrolidone to the ethylene glycol is greater than 1 show better low temperature pumpability. In the series of tests shown in Table IX, the mixtures containing component A4 (with a higher ratio of pyrrolidone and slightly less liquid phase) are more sensitive than the mixtures containing component A2 (with equal amounts of ethylene glycol and pyrrolidone) using the same oxidizer component and having the same oxygen balance. The parameters of density, ethylene glycol to pyrrolidone ratio, and total liquid content are factors affecting sensitivity. Where a soluble plastic pipe such as polyvinylchloride pipe is used to provide the flow channel at the detonation site, too much methylpyrrolidone in the mixture can result in damage to the pipe. However, where the pyrrolidone/ethylene glycol mixture is about a 1:1 ratio, the explosive formulation can be retained in PVC pipe for two weeks or longer without any deterioration of the pipe.

In making the fuel component it is important to add the thickening agent to the polyhydric alcohol prior to incorporating the pyrrolidone solvent. While it is possible to mix the pyrrolidone solvent and polyhydric alcohol first, hydration of the polymeric thickening agent is usually very slow when it is added to the mixture; thus, it is preferred to initially thicken the polyhydric alcohol and then add the pyrrolidone solvent.

The finely divided aluminum or other particulate metal fuel is then added to the mixture of polyhydric alcohol and pyrrolidone solvent. As noted previously, a coating agent is employed in order to increase the hydrophobicity of the particulate metal fuel and it is desirable that the coating agent be incorporated into the mixture prior to the addition of the aluminum. An especially suitable coating agent is an organo silane as described previously, specifically Silane 108 or Silane 208, although other coating agents such as titanates, zirconates, aluminates and stearates, etc. may also be employed.

The preferred thickening agent is xanthan gum in combination with guar gum as described previously. However, other suitable polymeric thickening agents including biopolymers such as starches, alginates, galloctomannan, and modified guar gums can be used. Synthetic polymers such as hydroxypropyl guar derivatives, galactomannan, carboxymethyl cellulose, hydroxymethyl cellulose, hydroxypropyl cellulose, carboxyethyl cellulose, hyroxyethyl cellulose, carboxymethyl hydroxyethyl cellulose, hydroxypropyl hydroxyethyl cellulose, polyacrylamides and polyvinyl alcohols can also be used.

Particulate metal fuels other than aluminum, such as those disclosed in the aforementioned patents to Thomison et al. and Chrisp, may also be used in carrying out the present invention. Metal fuels which might be used in place of, supplementary to, or alloyed with aluminum with proper protective coatings in order of preference might be magnesium, magnesium-aluminum alloys, silicon-zinc, ferrosilicon and ferrophosphorous. A small amount of a sensitizing explosive such as TNT can also be used in combination with such fuels to ensure detonability. The aluminum or other metallic fuel can also be supplemented by a dispersed carbonaceous fuel such as soft coal, gilsonite, charcoal, etc. Aluminum is preferred, from the standpoint of it being an energetic fuel, but also since the aluminum suspensions remain stable over wide temperature ranges for long periods of time, as noted above. Aluminum is particularly preferred in military applications since a sensitizer explosive is not required. The amount of aluminum will depend upon the amounts and characteristics of the other fuel components and the oxidizer components. Small amounts of aqueous salt solution of dissolved oxidizer salts such as $NaClO_4$, $NH_4ClO_4$, $Na_4NO_3$, etc. may be used in the fuel component to improve fluidity and oxygen balance; however, it is preferred to include only fuels which have no tendency to react prematurely with aluminum for long-term stability over wide temperature ranges. As a practical matter, the aluminum usually should be incorporated into the alcohol-/pyrrolidone liquid mixture in an amount to provide a weight ratio of aluminum to the liquid mixture within the range of about 4:1 to 1:1. The size distribution and shape of aluminum particles are important parameters in obtaining very high solids in the liquid carrier.

An advantage of the present invention is that the fuel and oxidizer components can be stored separately and transported in the separate nonexplosive state to the location at which the explosive formulation is to be used. The fuel and oxidizer components are then metered from their respective reservoirs and mixed under static conditions so that the metering pumps handle only the undetonable components and not the mixed explosive.

Figure 4:
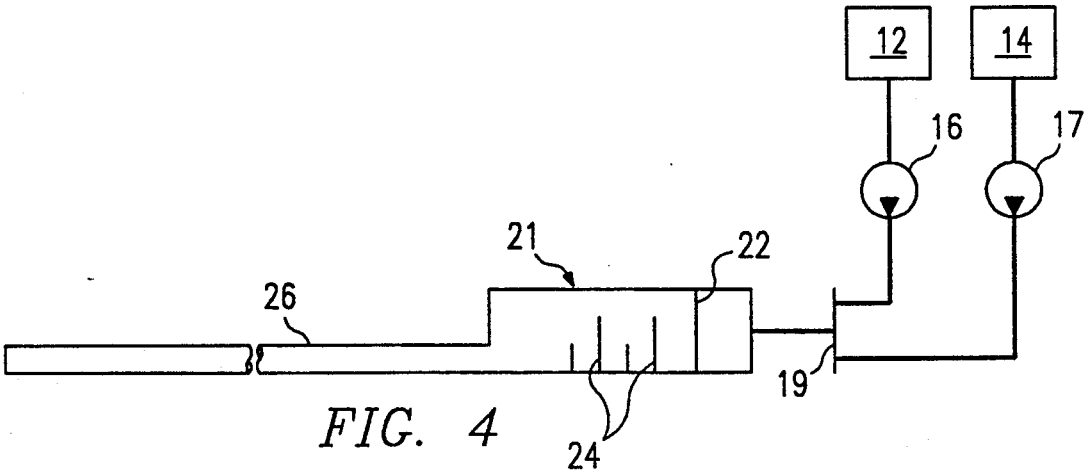
FIG. 4 is a schematic illustration of one mode of applying the present invention.

This mode of application is illustrated schematically in FIG. 4. As shown in FIG. 4, oxidizer components and the fuel component are stored in reservoirs 12 and 14 which can be mounted on the same or separate trailers or the like so that they can be transported from the point of formulation or storage to the detonation site. Reservoirs 12 and 14 are equipped with metering pumps 16 and 17, respectively. The components are pumped from their respective reservoirs in the desired relative amounts by operation of the pumps and supplied to a static mixing zone 21 which incorporates a plurality of baffle elements providing for tortuous flow to cause thorough mixing of the two components. For example, the mixing zone can comprise a front screen 22 and a plurality of irregular dams 24 as illustrated. The use of static elements, as contrasted with moving elements such as impellers, lessens the possibility of premature detonation. The resulting mixture is then forced under the applied pressure gradient resulting from the pumps into an elongated channel provided by a tube or hose 26 where the explosive is detonated.

Having described specific embodiments of the present invention, it will be understood that modification thereof may be suggested to those skilled in the art, and it is intended to cover all such modifications as fall within the scope of the appended claims.

What is claimed is:

1. In a method for the formulation of an explosive composition, the steps comprising:

(a) providing a fuel component of said explosive composition comprising a suspension of a particulate metal fuel in a carrier liquid formed of a mixture of a water miscible polyhydric alcohol and a pyrrolidone solvent and containing an amount of thixotropic thickening agent effective to provide a viscosity of said fuel component of at least 2000 centipoises at 20° C. and a shear rate of 20 rpm and no more than 100,000 centipoises at −20° C. and a shear rate of 10 rpm;

(b) providing an oxidizer component comprising an aqueous solution of an inorganic oxidizer salt; and (c) mixing said fuel component and said oxidizer component to provide a liquid explosive composition.

2. The method of claim 1, wherein said oxidizer component contains a thickening agent in an amount effective to provide a viscosity of said oxidizer component of at least 2000 centipoises at 20° C. and a shear rate of 20 rpm.

3. The method of claim 1, wherein said oxidizer component contains a minor amount of a polyhydric alcohol.

4. The method of claim 1, wherein at east one of said fuel component and said oxidizer component contains closed-cell void-containing material in an amount to provide a final density of said explosive composition at the conclusion of step (c) of no more than 1.55 g/cc.

5. The method of claim 4, wherein said fuel component contains closed-cell void-containing material.

6. The method of claim 1, wherein both of said oxidizer component and said fuel component contain closed-cell void-containing material.

7. The method of claim 1, wherein said oxidizer component contains closed-cell void-containing material in an amount to provide a density of said oxidizer component at 20° C. of no more than 1.29 g/cc.

8. The method of claim 1, wherein said particulate metal fuel comprises aluminum.

9. The method of claim 8, wherein said aluminum has an average particle size within the range of 5 to 100 microns.

10. The method of claim 1, wherein said polyhydric alcohol is selected from the group consisting of ethylene glycol, propylene glycol, diethylene glycol, diethylene glycol monomethylether, and mixtures thereof.

11. The method of claim 1, wherein said polyhydric alcohol is ethylene glycol.

12. The method of claim 10, wherein said pyrrolidone solvent is N-methylpyrrolidone.

13. The method of claim 1, wherein said fuel component contains a coating agent which enhances the hydrophobicity of said particulate metal fuel.

14. The method of claim 1, wherein said inorganic oxidizer salt comprises sodium perchlorate.

15. The method of claim 14, wherein said sodium perchlorate is present in said oxidizer component in an amount within the range of 40–70 wt. %.

16. The method of claim 15, wherein said sodium perchlorate is present in said oxidizer component in an amount within the range of 50–60 wt. %.

17. The method of claim 1, wherein the mixed explosive composition provided in step (c) is supplied to a detonation site and detonated.

18. The method of claim 17, wherein said fuel and oxidizer components are stored in separate reservoirs and further comprising separately pumping said fuel and oxidizer components from their respective reservoirs to a static mixing zone in which said components are mixed under tortuous flow conditions and supplying said mixed explosive composition to said detonation site.

19. The method of claim 18, wherein each of said fuel and oxidizer components is stored in its respective separate reservoir at a remote location and thereafter transported to the location at which said components are mixed.

20. The method of claim 1, wherein said pyrrolidone solvent is present in an amount to provide a ratio of said pyrrolidone solvent to said polyhydric alcohol within the range of 1:2–2:1.

21. In a method for the formulation of an explosive composition, the steps comprising:

(a) providing a fuel component for said explosive composition comprising a suspension of a particulate metal fuel in a carrier liquid formed of a mixture of a water miscible polyhydric alcohol and N-methyl pyrrolidone, said carrier liquid containing a thickening agent in an amount effective to provide a viscosity of said fuel component of at least 2000 centipoises at 20° C. and a shear rate of 20 rpm;

(b) providing an oxidizer component for said explosive formulation comprising an aqueous solution of sodium perchlorate; and (c) mixing said fuel component and said oxidizer component to provide a liquid explosive composition.

22. The method of claim 21, wherein said polyhydric alcohol comprises ethylene glycol.

23. The method of claim 22, wherein said particulate metal fuel comprises aluminum.

24. The method of claim 23, wherein said oxidizer component contains from 40–70 wt. % sodium perchlorate.

25. The method of claim 24, wherein said oxidizer component contains closed-cell void-containing material to reduce the density thereof.

26. The method of claim 25, wherein said closed-cell void-containing material is present in an amount to provide a density of said oxidizer component at 20° C. of no more than 1.25 g/cc.

27. The method of claim 26, wherein said aluminum fuel is present in said fuel component in an amount within the range of 40 to 80 wt. %.

28. The method of claim 27, wherein said sodium perchlorate is present in said oxidizer component in an amount within the range of 45–60 wt. %.

29. In a method for the formulation of a fuel component for use in a multicomponent explosive composition, the steps comprising:

(a) incorporating a polymeric thickening agent into a polyhydric alcohol carrier liquid in an amount effective to impart a viscosity to said polyhydric alcohol carrier liquid within the range of 1000 to 10,000 centipoises at 20° C. and a shear rate of 20 rpm;

(b) adding a pyrrolidone solvent to said thickened polyhydric alcohol carrier liquid; and (c) incorporating a particulate metal fuel into said carrier liquid mixture.

30. The method of claim 29, wherein said particulate metal fuel is aluminum.

31. The method of claim 30, further comprising the step of incorporating a coating agent for said aluminum into said liquid mixture prior to the addition of said aluminum.

32. The method of claim 30, wherein said polyhydric alcohol comprises ethylene glycol.

33. The method of claim 32, wherein said pyrrolidone solvent comprises N-methyl pyrrolidone.

34. The method of claim 33, wherein said N-methyl pyrrolidone is added to said thickened ethylene glycol in an amount to provide a ratio of N-methyl pyrrolidone to ethylene glycol within a range of 0.5–2.0.

35. The method of claim 34, wherein said N-methyl pyrrolidone is added in an amount to provide a weight ratio of N-methyl pyrrolidone to ethylene glycol within the range of 0.6–1.5.

36. The method of claim 34, wherein said aluminum is incorporated in said liquid mixture in an amount to provide a weight ratio of aluminum to said liquid mixture within the range of 4:1 to 1:1.

37. The method of claim 29, further comprising the step of incorporating closed-cell void-containing material into said carrier liquid mixture.

* * * * *

UNITED STATES PATENT AND TRADEMARK OFFICE

CERTIFICATE OF CORRECTION

PATENT NO. : 5,007,973

DATED : April 16, 1991

INVENTOR(S) : Richard E. Trapp et al.

It is certified that error appears in the above-identified patent and that said Letters Patent is hereby corrected as shown below:

Title Page:

Abstract, Line 4, delete "compnent" and insert therefore --component--.

Column 1, Line 13, delete "water soluble" and insert therefore --water-soluble--.

Column 1, Line 47, delete "i then" and insert therefore --is then--.

Column 8, Line 41 in Table III, Carrier Liquid Column, delete "EM" and insert therefore --DM--.

Column 9, Line 44 in Table V, Ingredient Column, delete "Viscosity (cP @ 20° C.)" and insert therefore --Viscosity (cp @ 20° C.)--.

Column 12, Line 50, delete "closed cell" and insert therefore --closed-cell--.

Column 12, Line 62, delete "void containing" and insert therefore --void-containing--.

Column 13, Line 19, delete "solution The water" and insert therefore --solution. The water--.

Column 13, Line 23, delete "abscissa As" and insert therefore --abscissa. As--.

UNITED STATES PATENT AND TRADEMARK OFFICE

CERTIFICATE OF CORRECTION

PATENT NO. : 5,007,973

DATED : April 16, 1991

INVENTOR(S) : Richard E. Trapp et al.

It is certified that error appears in the above-identified patent and that said Letters Patent is hereby corrected as shown below:

Column 13, Line 25, delete "perchlorate Since the" and insert therefore --perchlorate. Since the--.

Column 15, Line 30, delete "alcohol-/pyrrolidone" and insert therefore --alcohol-pyrrolidone--.

Column 16, Line 30, delete "east" and insert therefore --least--.

Column 16, Line 54, delete "claim 1," and insert therefore --claim 10,--.

Signed and Sealed this

Twenty-fifth Day of May, 1993

*Attest:*

*Attesting Officer*

Michael K. Kirk

MICHAEL K. KIRK

*Acting Commissioner of Patents and Trademarks*